US005575115A

United States Patent [19]

Lindgren et al.

[11] Patent Number: 5,575,115

[45] **Date of Patent: *Nov. 19, 1996**

[54] WINDOW WITH A FRAME OF EXTRUDED PROFILE MEMBERS

[75] Inventors: Claes Lindgren, Farum; Flemming O. Petersen, Bloustrod/Allerod; Stig F. Vigenberg, Gilleleje, all of Denmark

[73] Assignee: V. Kann Rasmussen Industri A/S, Søborg, Denmark

[ * ] Notice: The term of this patent shall not extend beyond the expiration date of Pat. No. 5,394,649.

[21] Appl. No.: 202,251

[22] Filed: Feb. 25, 1994

Related U.S. Application Data

[63] Continuation-in-part of Ser. No. 802,640, Dec. 9, 1991, Pat. No. 5,394,649.

[30] Foreign Application Priority Data

Dec. 6, 1991 [DK] Denmark ..... 1972/71

[51] Int. Cl.[6] ..... E06B 11/00

[52] U.S. Cl. ..... 49/381; 49/397; 160/92; 160/107

[58] Field of Search ..... 49/381, 333, 397, 49/339, 402, 346, 63, 341, 61, 342, 336; 160/90, 92, 96, 98, 107, 108

[56] References Cited

U.S. PATENT DOCUMENTS 2,819,065 1/1958 Jones ..... 49/341 X 5,394,649 3/1995 Lindren et al. ..... 49/381

*Primary Examiner*—Jerry Redman

*Attorney, Agent, or Firm*—Lane, Aitken & McCann

[57] ABSTRACT

In a window with a frame of extruded profile members the exterior side of an edge portion of a thermo pane is supported by a first flange portion of the profile member and the inside by a glazing bead connected with the frame profile member. The main frame mainly consists of wood profiles, the exterior sides of which are covered by weather-resisting coverings. A hinge member at the top of the window comprises an edge portion (28) of an extruded profile member (27) forming a hinge pivot firmly connected to the main frame portion (20) at this side and a hook-shaped wall portion (6) of the opposite frame profile member (1) forming a hinge blade. At one of the other sides of the window an arrangement is provided to ensure engagement of said hinge pivot and hinge blade forming portions in the closed position of the window. Such arrangements may comprise a sliding block (31) arranged displaceably in a track in the frame profile member, which block can be moved between a position opposite a retaining device anchored in the main frame structure for permanently securing the frame in case of a fixed window and a position in which it can be connected to a motion transfer member which is guided in a recess in the wood profile of the main frame for complete accommodation of the motion transfer member in the closed position of an openable window.

13 Claims, 6 Drawing Sheets

WINDOW WITH A FRAME OF EXTRUDED PROFILE MEMBERS

CROSS REFERENCE TO RELATED APPLICATION

This is a continuation-in-part of Ser. No. 07/802,640, now U.S. Pat. No. 5,394,649 filed on Dec. 9, 1991.

BACKGROUND OF THE INVENTION

The invention relates to a window, comprising a frame of extruded profile members which at their exterior side surfaces parallel to the glass plane have a first flange portion as a supporting member for an edge portion of a thermo pane on the external side thereof, whereas an opposite edge portion at the inside of the thermo pane is supported by a glazing bead connected with the profile member, and a main frame mainly consisting of wood profiles, the exterior surfaces of which are covered by weather-resisting coverings.

The invention mainly but not exclusively has as object windows designed as top-hinged roof windows to be installed in inclined roofs.

Windows of said type must, when openable, normally be provided with separate, robust hinge elements and motion transfer connections between the frame and the main frame; this partly causes an increase of the production costs and, partly often mars the appearance of the window.

Also, if it is desired to provide the window with accessories known per se such as a roller blind, a Venetian blind, an insect screen or the like, separate fastening and movement control members for such accessories are required.

In openable windows of this type it is known per se to use motor control for the opening/closing movement and also for said accessories, but this has usually required specially designed frame and main frame structures often with relatively complicated electrical wiring.

SUMMARY OF THE INVENTION

The primary object of the invention is to provide a window with a comparatively simple frame and main frame structure in which the movement control members and possible driving members for the opening closing movement of an openable window and/or accessories of the above-mentioned type in so far as is possible are integrated in the frame and main frame profiles.

A further object of the invention is to show a window structure which without significant changes of the frame and main frame profiles and in a relatively economical way can be extended from a simple design as a fixed window into an openable window either manually operated or through a further extension into an advanced structure with motor control of the opening/closing movement and possible accessories.

In addition, a particular object of the invention is to provide a motion transfer member for use in manually operated or motor-controlled openable windows of a very simple structure and design which as little as possible disfigures the frame and main frame structures whether these are seen from the inside or outside.

According to a first aspect of the invention a window of said type is characterized in that a hinge member at the top of the window comprises an edge portion of an extruded profile member forming a hinge pivot firmly connected to the main frame portion at this side and a hook-shaped wall portion of the opposite frame profile member forming a hinge blade, whereas at one of the other sides of the window means are provided to ensure engagement of said hinge pivot and hinge blade forming portions in the closed position of the window.

Besides avoiding cost-increasing hinge structures and motion transfer members, the hinge element directly integrated in the frame and main frame structure facilitates the mounting process inasmuch as the frame can be hooked on to the main frame structure in a simple way after the latter has been fastened in the roof opening.

According to a second aspect of the invention a window of said type in which the frame and main frame are hinged at one side is characterized in that a coupling member is arranged at one of the other sides which can be moved between a position opposite a retaining device anchored in the main frame structure for permanently securing the frame in case of a fixed window and a position in which it can be connected to a motion transfer member which is guided in a recess in the wood profile of the main frame for complete accommodation of the motion transfer member in the closed position of an openable window.

With this design, one and the same window structure can without changes of the frame and main frame profiles be used as a fixed window, partly extended or modernized as manually operated or motor-controlled openable window.

According to a third aspect of the invention a window as mentioned initially is characterized in that extruded profile members are fastened to the side of the main frame wood profiles facing the light admitting area of the window to form tracks for reception and movement control of accessories such as a roller blind, an insect screen and/or a Venetian blind and that one or more of the main frame wood profiles are provided with a recess to accommodate one or more drive motors for said accessories, and that the main frame wood profiles are provided with factory-mounted wiring underneath the weather-resisting coverings for power supply to said motors.

This embodiment permits a stepwise extension of a relatively inexpensive, simple window structure into a more sophisticated design with various accessories and motor control.

According to a further aspect of the invention a window as mentioned initially, having a frame of extruded profile members which at their exterior side surfaces parallel to the glass plane having a first flange portion of a thermo pane on the external side thereof, whereas an opposite edge portion at the inside of the thermo pane is supported by a glazing bead connected with the profile member, and a main frame mainly consisting of wood profiles, the exterior surfaces of which are covered by weather-resisting coverings, the frame profiles being provided with wall portions which form tracks for sealing strips for sealing engagement with parts of the weather-resisting main frame coverings for insulation between these and the frame profiles is characterized in that one of said extruded profile members on the main frame wood profile and one of said wall portions of the frame profiles are arranged for alternative connection to fixing elements of an accordion-folded insect screen, which in a openable window is positioned between the side and bottom portions of the frame and main frame.

In this design a top-hinged openable window will already in its supply condition be ready for mounting of an accordion-folded insect screen which efficiently covers the opening between the frame and the main frame in the open position of the window.

The invention also relates to a window with a frame of extruded profile members which at their exterior side surfaces parallel to the glass plane have first flange portion as a supporting member for an edge portion of a thermo pane on the external side thereof, whereas an opposite edge portion at the inside of the thermo pane is supported by a glazing bead connected with the profile member, and a main frame mainly consisting of wood profiles, the exterior surfaces of which are covered by weather-resisting coverings, whereas the frame and the main frame are hinged on one side and a motion transfer member is connected between the frame and the main frame at at least one of the sides at right angles hereto.

For the purpose of providing an extremely simple and robust motion transfer member, to an extent as possible arranged as an embedded installation for such an openable window according to this further aspect of the invention the window is characterized in that the motion transfer member is a rack in engagement with a toothed wheel which is accommodated in a recess so as to be retained in the closed position of the window.

BRIEF DESCRIPTION OF THE DRAWINGS

As a common embodiment of the invention in its various aspects a top-hinged openable roof window for installation in an inclined roof is described in the following with reference to the drawings, in which.

DETAILED DESCRIPTION OF THE PREFERRED EMBODIMENTS

Figure 1:
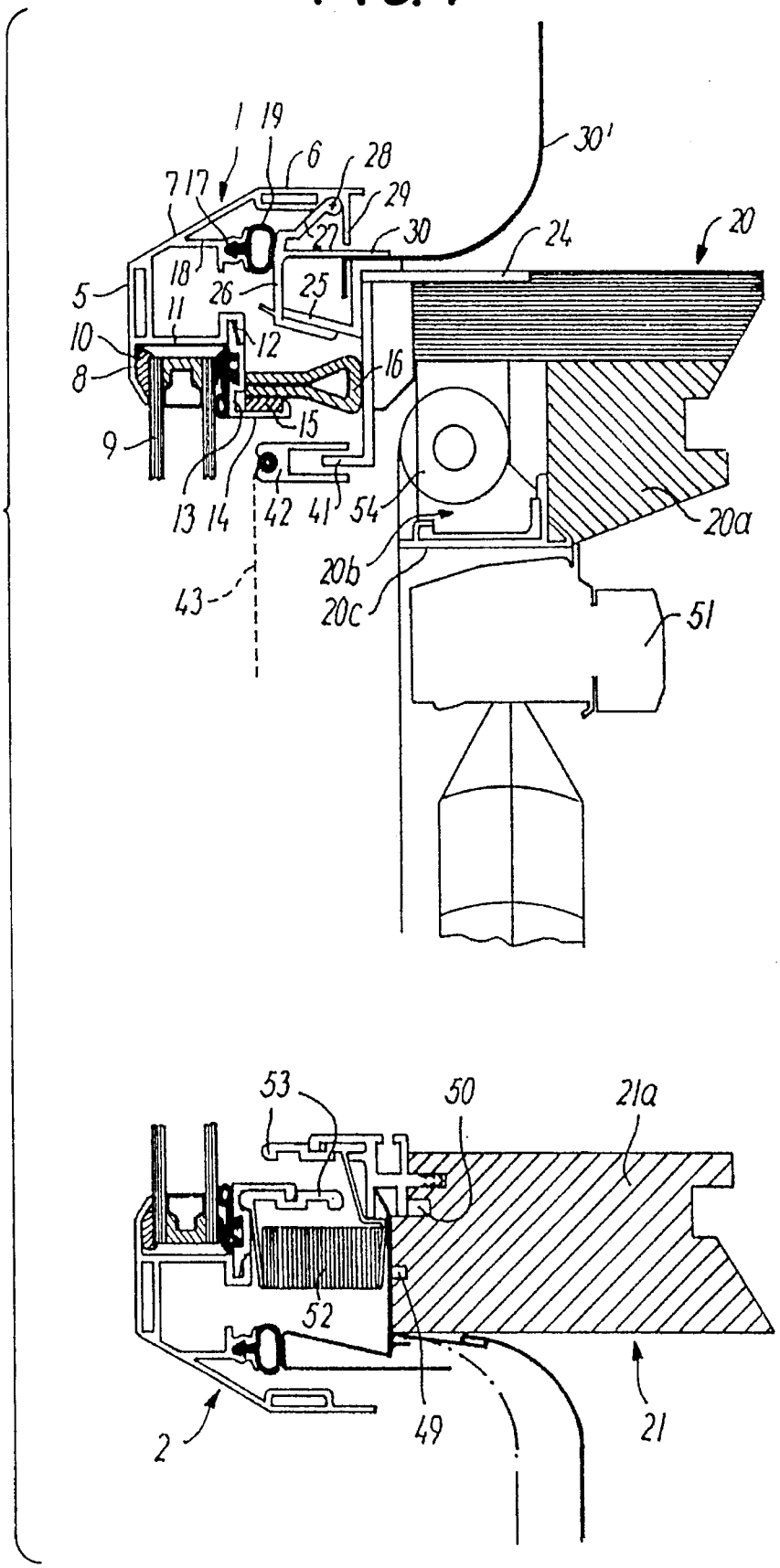
FIG. 1 is a vertical, longitudinal sectional view of the window, taken along the line 1—1 of FIG. 12.
Figure 2:
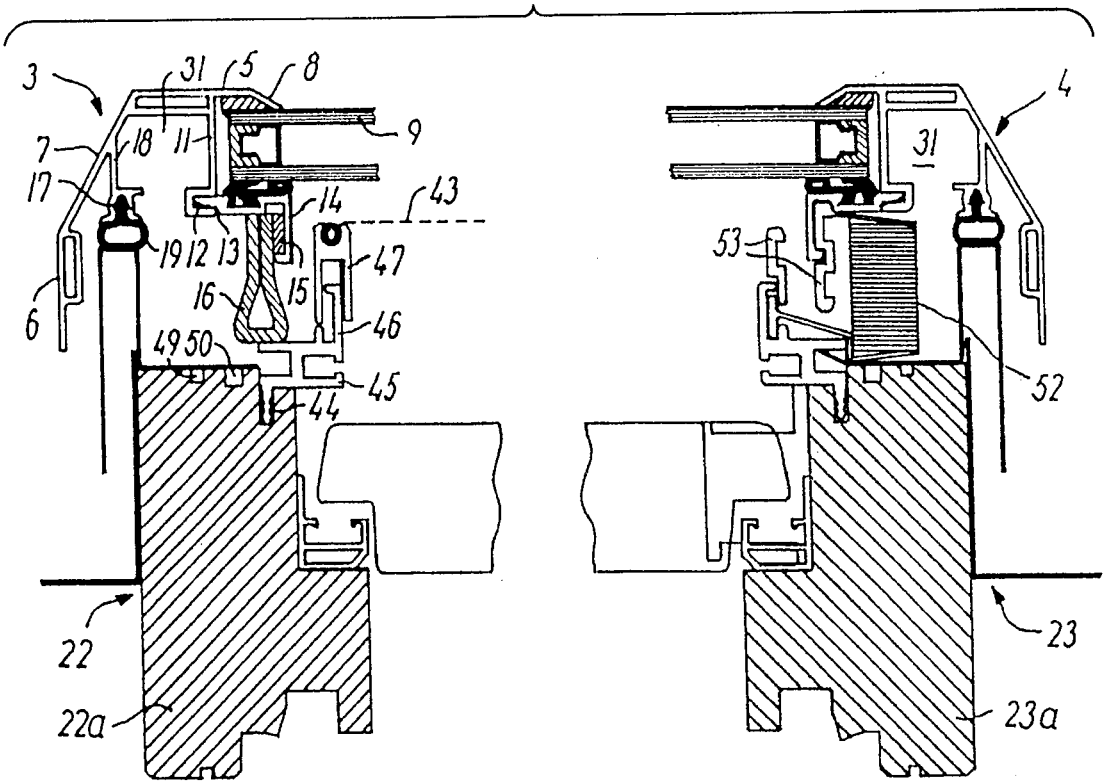
FIG. 2 is a horizontal transverse section through the window of FIG. 1, at right angles to the window plane, taken along the line 2—2 of FIG. 12.

In the embodiment shown in the sectional views in FIGS. 1 and 2 the window according to the invention comprises a frame made of extruded profile members, preferably aluminium, of which FIG. 1 shows the top portion 1 and the bottom portion 2, and FIG. 2 the two vertical side portions 3 and 4.

The frame profile members 1–4 have the same basic cross section which as shown in FIG. 1 can be substantially L-shaped with a first wall portion 5 parallel to the glass plane and an exterior wall portion 6 at right angles hereto connected via an oblique corner portion 7.

The first wall portion 5 comprises a flange part 8 as a supporting member for an edge portion at the outside of a thermo pane 9 at sealing means 10.

A flange portion 11 projecting inwards at right angles to the wall portion 5 is at its free end provided with a track 12 for accommodation of a glazing bead 13, which supports the edge portion of the thermo pane 9 at the opposite side.

The glazing bead 13 is substantially L-shaped with a flange portion 14 projecting inwards at right angles to the glass plane forming a track 15 for retaining a comparatively wide sealing strip 16 for sealing between the frame and the main frame 1 in the closed position of the window.

In the drawing this sealing strip 16 is only shown in connection with the frame top portion 1 in FIG. 1 and the left vertical wall portion 3 in FIG. 2, but in the embodiments which comprise the sealing strip it is normally arranged in connection with all four frame profile members.

In a track 17 formed by a flange portion 18 inwards projecting from the oblique corner portion 7 a sealing strip 19 is accommodated in a corresponding manner defining the outer sealing plane of the window.

The main frame portions positioned opposite the frame profile members 1–4 in the window after installation comprise a top portion 20 and two vertical frame portions 22 and 23. The frame portions are mainly made of wood profiles 20*a*, 21*a*, 22*a* and 23*a*, the exterior surfaces of which are covered by weather-resisting coverings.

The wood profile 20*a* of the top portion is composed of two members which together form a duct 20*b* facing the thermo pane 9 which at its bottom is delimited by a metal profile member 20*c* projecting outwards from the wood profile and can be used to accommodate a roller blind rod 54. The weather-resisting covering here comprises an L-shaped metal profile member 24, which covers the side of the wood profile 20*a* facing the thermo pane 9 and part of the top side of the profile.

A likewise L-shaped metal profile member 25 is fastened to the profile member 24 and connected with an extruded profile member 26.

According to a first aspect of the invention this profile member 26 is provided with an upwards projecting oblique flange portion 27, of which an edge portion 28 of increased thickness forms a hinge pivot for engagement with flange portion 29 projecting downwards from the exterior wall partion of frame top portion 1, whereby the exterior wall portion 6 forms a hook-shaped hinge blade.

In this embodiment a hinge member which permits opening and closing of the frame in relation to the main frame by turning around the axis defined by the edge portion 28 is designed as an integral part of the frame and main frame top portions.

The use of separate production cost increasing hinge members is thus avoided and the shown top-hinged embodiment facilitates mounting since the frame can relatively easily be hooked on to the hinge pivot forming edge portion 28 after installation of the main frame.

In the shown embodiment where the window is designed for installation in an inclined roof the profile member 26 can furthermore be provided with a flange portion 30 projecting parallel to the top side of the profile member 25 so that, the surrounding, e.g. sheet-shaped sealing material 30 can be wedged in between the flange portion 30 and the profile member 25.

Figure 3:
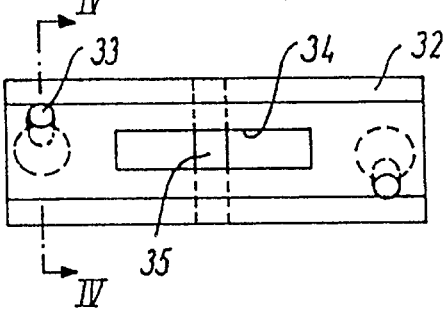
FIG. 3 shows a coupling member according to the invention.
Figure 4:
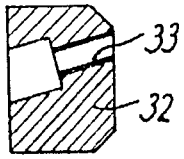
FIG. 4 is a cross section of the coupling member, along line 4—4 shown FIG. 3.

As it most clearly appears from FIG. 2, the flange portions 11 and 18 projecting inwards from the frame profile members form a track with a mainly square cross section, which in the vertical frame portions 3 and 4 can be used to accommodate a block shown in FIGS. 3 and 4 which is displaceable in the track and can be retained in random position in same by means of fixing screws arranged in oblique holes 33.

The block 32 serves as a coupling member for connection of the frame either with a locking device permanently fastened to the frame portion in a fixed window or with a motion transfer member connected to an opening/closing device mounted in the main frame portion.

Figure 5:
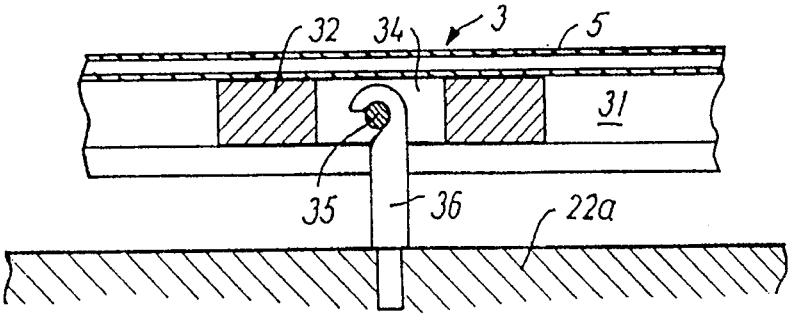
FIG. 5 shows the connection between the frame and mainframe in a fixed window.

In a fixed window the coupling member 32 is fastened in the track 31, as shown in FIG. 5, at the bottom part of the vertical frame portions and connected to an arm 36 which is fastened to the main frame portion by means of a fitting which may be positioned beneath the weather-resisting covering.

In an openable window the coupling member 32 is fastened in the track 31 in the upper part of the frame portion.

Figure 6:
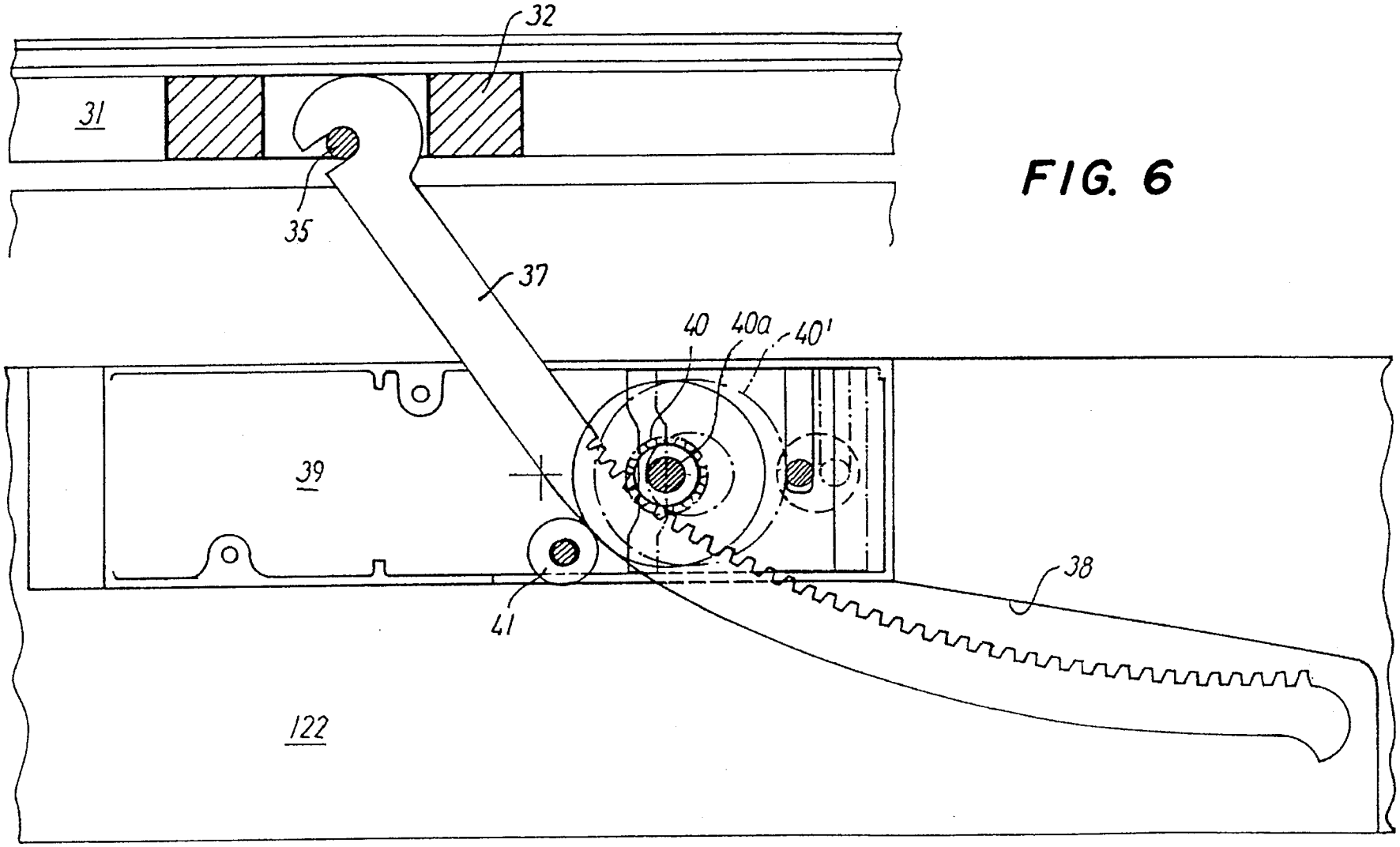
FIG. 6 Shows an opening/closing device according to the invention.

In the embodiment shown in FIG. 6 the motion transfer member consists of a curved rack 37 in engagement with an opening/closing device 39 arranged in a recess 38 in the exterior side of the main frame profile. The recess 38 is as shown designed so that it can accommodate the entire length of the curved rack 37 in the closed position of the window.

Figure 7:
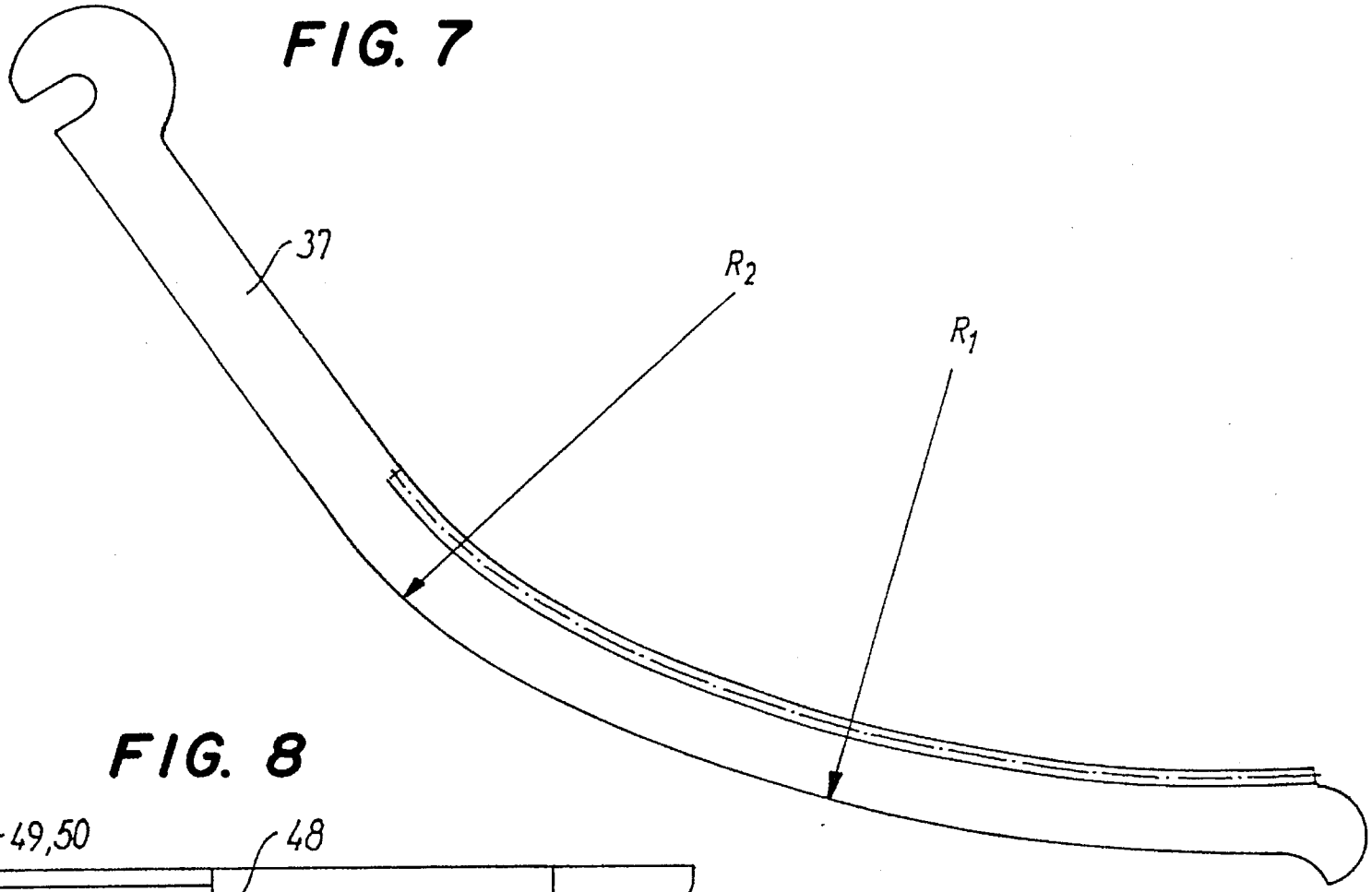
FIG. 7 shows a detail of the opening/closing device shown in FIG. 6.

In the opening/closing device 39 the rack 37, which as shown in FIG. 7 is toothed on the concave side, is in engagement with a toothed wheel 40 which via a transmission not shown is run by an electromotor with reversible direction of rotation.

Opposite the toothed wheel 40 the rack is supported by a supporting wheel 41 on its convex side.

In order to allow release of the engagement between the rack 37 and the toothed wheel 40 the toothed wheel is preferably mounted eccentrically, e.g. by an eccentric connection between its axle journal 40A and an operating member that can be turned and which is accessible from the inside of the main frame portion so that when it is turned manually the toothed wheel 40 is released from its engagement with the rack 37, for example to position 40'shown in dotted line, whereby the latter can be completely released from the main frame portion when the window is opened manually.

The special coupling member 32, which permits changing a fixed window into an openable window is not restricted to use in top-hinged windows or in connection with the integral hinge member described above. Nor is it restricted to use together with the described opening/closing device and the motion transfer member designed as a rack.

The same applies to the described embodiment of the opening/closing device and the rack, the use of which is not restricted to top-hinged windows or together with the integral hinge member or the special coupling member.

In the top-hinged window shown, the concave side of the rack 37 can be designed with such a curvature variation, e.g. as shown in FIG. 7, with a curvature radius $R_2$ on a short length of the end of the toothing closest to the coupling member 32 which is considerably smaller than curvature radius $R_1$ on the remaining length of the rack, whereby an advantage is obtained, i.e. That the rack 37 never projects beyond the inside 122 of the main frame wood profile.

The distance from the hinge outside FIG. 6 to the right to the engagement point of the rack 37 at the pivot 35 in the shown embodiment is larger than the distance from said hinge to the engagement point of the rack 37 with the toothed wheel 40. Hereby the advantage is obtained that the window frame after having reached the closing position in continuation of the closing movement is lifted briefly towards the hinged side whereby it is brought in abutment on the main frame, and sealing between the sealing strips 16 and 19 and the main frame portions abutting on same is ensured.

As it appears from FIGS. 1 and 2 the window can be manufactured so as to be ready for mounting of accessories such as, e.g. a roller blind, an insect screen or a Venetian blind.

The profile member 24 in the main frame top portion can thus be designed with a projecting flange portion 41' for clipping on an edge fastening member 42 at one side of a fixed insect screen 43, and the main frame side portions and bottom portions can be provided with tracks 44 for accommodation of extruded profile members 45 with projecting flange parts 46 for clipping on edge fastening members 47 at the sides and lower edge of such an insect screen.

Figure 8:
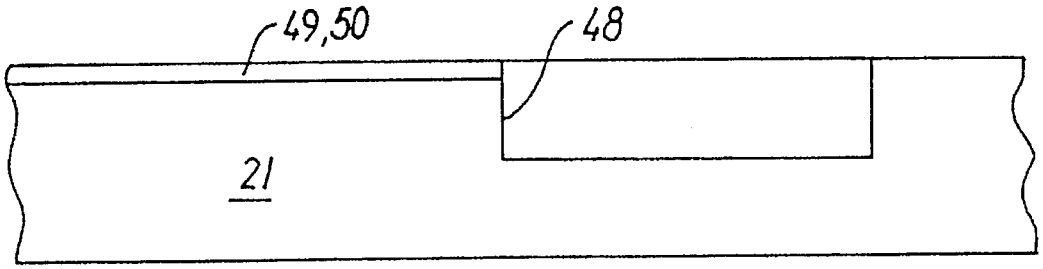
FIG. 8 shows a main frame bottom portion ready for arrangement of an accessory motor.

The window can likewise already when supplied be arranged for motor control of, e.g. a roller blind as shown in FIG. 1 where as shown in FIG. 8 the wood profile member of main frame bottom portion 21 may be provided with a recess 48 for accommodation of an electrical drive motor which in a manner known per se can operate a roller blind by means of a cord arrangement connected to said bottom portion.

In connection herewith the main frame members may in their supply condition be provided with embedded wiring for which, as shown in FIG. 2, grooves 49–50 can be provided in one of the surfaces of the main frame members which subsequently is covered by weather-resisting coverings.

In connection with such wiring a switch member can be provided in one of the main frame side portions for an electrical plug-and-socket connection for the drive motor of the Venetian blind 51, which as shown in FIG. 1 can be mounted immediately below the main frame top portion 20.

In addition, the main frame bottom portion 21 as shown in FIG. 1 and the right side portion 23 as shown in FIG. 2 may be arranged for mounting of an accordion-folded insect screen 52 of a design known per se. Such a screen is fastened both to the main frame and the frame at the two side portions and at the bottom portion so that the openings between the main frame and the frame are completely screened.

The track 15 in the main frame formed by the glazing bead 13, otherwise used for mounting of the sealing strip 16, is used for mounting of the accordion-folded screen 52, as well as the projecting flange portions 46 of the profile members 45 of the frame, alternatively used for mounting of the fixed insect screen 43.

In order to facilitate mounting the accordion-folded insect screen 52 can be provided with fastening members 53, which can be clipped on said flange portions.

Figure 9:
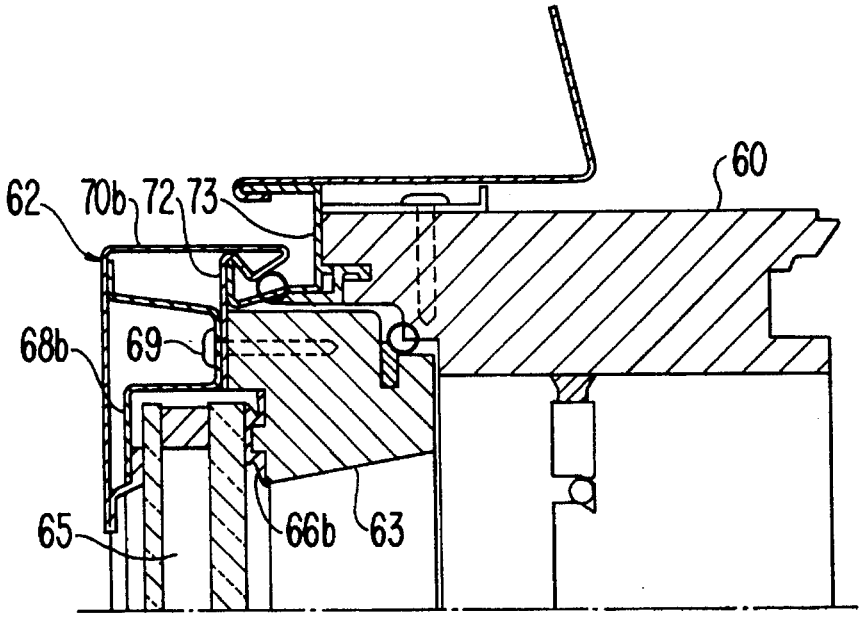
FIG. 9 is a vertical, longitudinal sectional view through a top portion of an alternate embodiment of the window according to the present invention.
Figure 10:
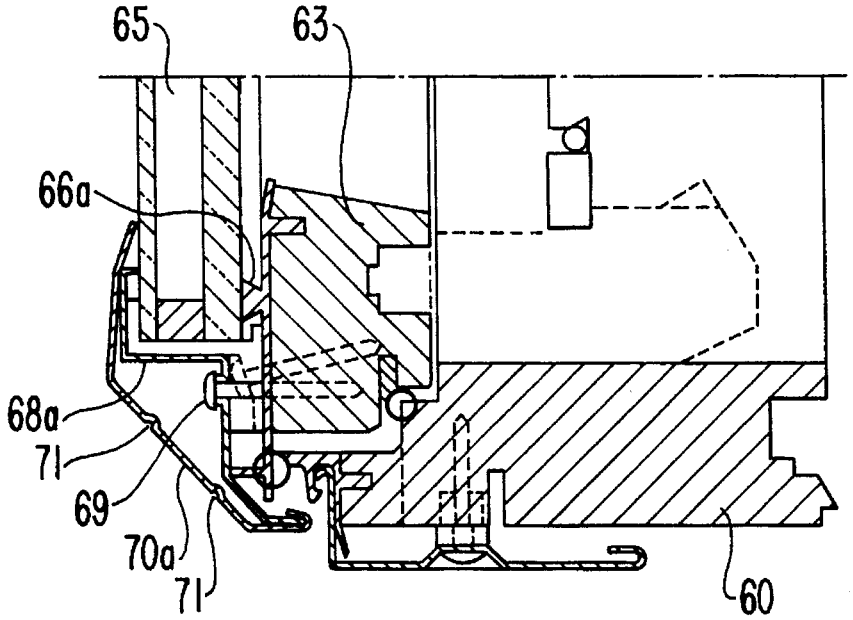
FIG. 10 is a vertical cross section taken through a bottom portion of the window of FIG. 9.
Figure 11:
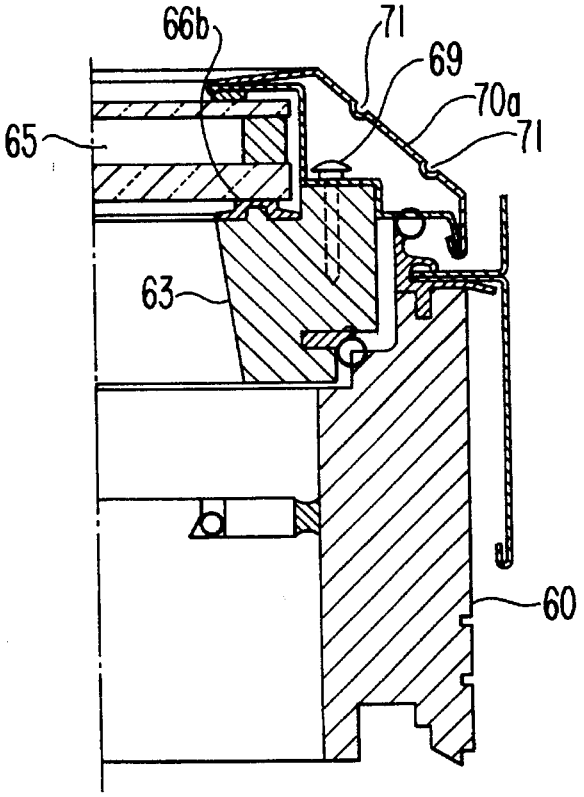
FIG. 11 is a horizontal cross section looking up taken through right side portion of the window FIGS. 9 and 10, when viewed from the left.
Figure 12:
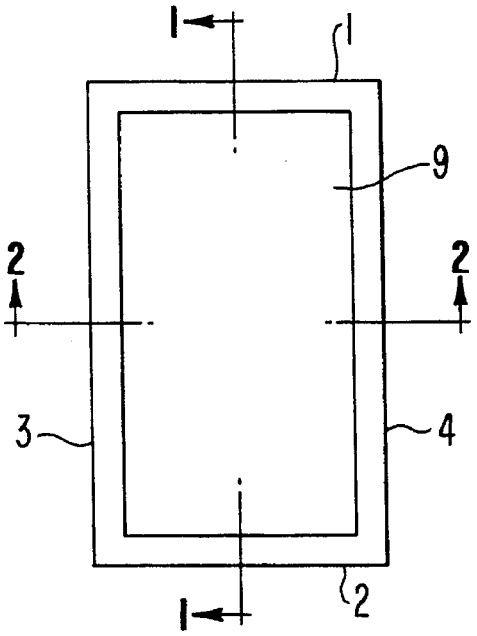
FIG. 12 is a schematic illustration of the window according to the present invention.

As can be seen from FIGS. 9–11, an alternate embodiment of the window according to the present invention includes a stationary main frame 60 for installation in the roof construction. The sash 62 comprises an internal wood frame 63 having a glazing recess on its external side. The pane member 65 rests against a seal 66*a*, 66*b* in the glazing recess and is retained on its external side by pane holding profile members 68*a*, 68*b* of metal or plastic which are secured to the wood frame 63 by screws 69. The pane holding members, the screws and the wood frame are not visible from the outside and are protected against the weather by covering profiles 70*a*, 70*b* of roll formed or extruded aluminum. The covering profile 70*b* at the top frame member gives the window a characteristic shape and provides beneath it sufficient space for the installation of electrical wiring or cords for external screening equipment. The covering profiles 70*a* at the side and bottom frame members have longitudinal depressions 71 which serve to reinforce the profiles and provide a slender shape. As seen in FIG. 9, the hinge assembly at the top frame member comprises a hinge part 72 connected with the frame member and a hinge part 73 connected with the main frame member.

In all respects not specifically described or illustrated, the embodiment represented by FIGS. 9–11 is like the embodiment of FIGS. 1–8. For example, the window of the embodiment of FIGS. 9–11 can be openable or fixed. Where such a window is openable, it can have an opening/closing device like that of FIGS. 6 and 7. Where it is a fixed window, it can have a connection between the frame and the main frame like the connection of FIG. 5.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

We claim:

1. A window having a top side and other sides comprising a first frame of first extruded profile members each having an exterior side surface parallel to a plane defined by a thermo pane of glass and having at the exterior side surface a first flange portion acting as a supporting member for an edge portion of the thermo pane on an external side of the thermo pane, whereas an opposite edge portion of the thermo pane at an internal side of the thermo pane is supported by a glazing bead connected with the extruded profile members, and a main frame comprising wood profiles having exterior surfaces covered by weather-resisting coverings, a hinge member at the top side of the window comprising a hinge pivot formed by an edge portion of a second extruded profile member connected to a portion of said main frame and a hinge blade defined by a hook-shaped wall portion of an opposed one of said first extruded profile members of said first frame, and ensuring means for maintaining continued engagement of said hinge pivot and said hinge blade, characterized in that the hook-shaped wall portion defining the hinge blade comprises a flange on an upper exterior side wall of one of said first extruded profile members, said flange projecting downwardly substantially parallel to the glass plane, whereas the hinge pivot forming edge portion is formed by an upwardly projecting flange of said second extruded profile member, said upwardly projecting flange being adapted to be engaged by said hinge blade by hooking said hinge blade around said hinge pivot forming edge portion with said downwardly projecting flange positioned behind said upwardly projecting flange, said engagement ensuring means being provided at at least one of the other sides of the window.

2. A window as claimed in claim 1, characterized in that said other sides of the window include vertical sides, said engagement ensuring means is provided at at least one vertical side of the window, said engagement ensuring means comprising a member fastened to one of said first extruded profile members.

3. A window as claimed in claim 2, characterized in that said member of said engagement ensuring means is a sliding block arranged displaceably in a track in said one of said first extruded profile members, said block being movable between a position opposite a retaining device anchored in the main frame for permanently securing said first frame, in the case of a fixed window, and a position for connection to a motion transfer member guided in a recess in one of the wood profiles of the main frame for complete accommodation of the motion transfer member, in the closed position of an openable window.

4. A window as claimed in claim 1, characterized in that said first extruded profile members are provided with wall portions forming tracks for sealing strips for sealing engagement on parts of said weather-resisting coverings of said wood profiles and for insulation between the weather-resisting coverings and said first extruded profile members.

5. A window as claimed in claim 4, characterized in that one of said wall portions is defined by the glazing bead.

6. A window as claimed in claim 1 and designed as a roof window to be mounted in an inclined roof, characterized in that the weather-resisting coverings for weather-resistant connection between the main frame and the surrounding roofing material are retained between the wood profile coverings or between the wood profile coverings and the main frame wood profiles.

7. A window having a top side and other sides, comprising a thermo pane of glass, a first frame of first members each having an exterior side surface and a first flange portion acting as a supporting member for an edge portion of the thermo pane on an external side of the thermo pane, whereas an opposite edge portion of the thermo pane at an internal side of the thermo pane is supported by a glazing bead, and a main frame comprising wood profiles having exterior surfaces covered by weather-resisting coverings, a hinge member at the top side of the window comprising a hinge pivot formed by an edge portion of a profile member connected to a portion of said main frame and a hinge blade defined by a hook-shaped wall portion of an opposed one of said first members of said first frame, and ensuring means for maintaining continued engagement of said hinge pivot and said hinge blade, characterized in that the hook-shaped wall portion defining the hinge blade comprises a flange on an upper exterior side wall of one of said first members, said flange projecting downwardly, whereas the hinge pivot forming edge portion is formed by an upwardly projecting flange of said profile member, said upwardly projecting flange being adapted to be engaged by said hinge blade by hooking said hinge blade around said hinge pivot forming edge portion with said downwardly projecting flange positioned behind said upwardly projecting flange, said engagement ensuring means being provided at at least one of the other sides of the window.

8. A window as claimed in claim 7, characterized in that said other sides of the window include vertical sides, said engagement ensuring means is provided at at least one vertical side of the window, said engagement ensuring means comprising a member fastened to one of said first members.

9. A window as claimed in claim 8, characterized in that said member of said engagement ensuring means is a sliding block arranged displaceably in a track in said one of said first extruded profile members, said block being movable between a position opposite a retaining device anchored in the main frame for permanently securing said first frame, in the case of a fixed window, and a position for connection to a motion transfer member guided in a recess in one of the wood profiles of the main frame for complete accommodation of the motion transfer member, in the closed position of an openable window.

10. A window as claimed in claim 7, characterized in that said first members are provided with wall portions forming tracks for sealing strips for sealing engagement on parts of said weather-resisting coverings of said wood profiles and for insulation between the weather-resisting coverings and said first members.

11. A window as claimed in claim 10, characterized in that one of said wall portions is defined by the glazing bead.

12. A window as claimed in claim 7 and designed as a roof window to be mounted in an inclined roof, characterized in that the weather-resisting coverings for weather-resistant connection between the main frame and the surrounding roofing material are retained between the wood profile coverings or between the wood profile coverings and the main frame wood profiles.

13. A window having sides and comprising a thermo pane of glass, a first frame of first members each having an exterior side surface and a first flange portion acting as a supporting member for an edge portion of a thermo pane on an external side of the thermo pane, an opposite edge portion of the thermo pane at an internal side of the thermo pane is supported by a glazing bead, and a main frame comprising wood profiles having exterior surfaces covered by weather-resisting coverings, the first frame and the main frame being hinged to one another on one of the sides of the window, characterized in that the window has means for permanently securing said first frame to define part of a fixed window and for completely accommodating a motion transfer member guided in a recess in one of the wood profiles in the closed position of an openable window, said securing means comprising a coupling member connected with one of said first members on another one of the sides of the window, said coupling member being positioned in a first position on said one of said first members for permanently securing the first frame and in second position on said one of said first members different from the first position for completely accommodating the motion transfer member in the closed position of an openable window.

* * * * *

UNITED STATES PATENT AND TRADEMARK OFFICE

CERTIFICATE OF CORRECTION

PATENT NO. : 5,575,115

DATED : November 19, 1996

INVENTOR(S) : Claes Lindgren et al.

It is certified that error appears in the above-indentified patent and that said Letters Patent is hereby corrected as shown below:

Column 1, line 43, change "opening closing" to --opening/closing--;

Column 3, line 52, after "through", insert --a--;

line 53, after ";" insert --and--;

same line, "FIG." should start a new paragraph;

Column 4, line 65, change "30" to --30'--.

Column 5, line 65, "That" should read --that--;

Column 9, line 20, before "an" (second occurrence), insert --wherein--;

and

Column 10, line 15, before "second", insert --a--.

Signed and Sealed this

Fifteenth Day of July, 1997

Bruce Lehman

*Attest:*

BRUCE LEHMAN

*Attesting Officer*

*Commissioner of Patents and Trademarks*